US005232432A

United States Patent [19]

Eberle

[11] Patent Number: 5,232,432

[45] Date of Patent: Aug. 3, 1993

[54] ANGULAR HEAD FOR CENTRIFUGES

[76] Inventor: Günter Eberle, Gartenstrasse 100, D-7200 Tuttlingen, Fed. Rep. of Germany

[21] Appl. No.: 799,356

[22] Filed: Nov. 27, 1991

[30] Foreign Application Priority Data

Nov. 30, 1990 [DE] Fed. Rep. of Germany ..... 9016288

[51] Int. Cl.[5] ..... B04B 5/02

[52] U.S. Cl. ..... 494/16; 494/81

[58] Field of Search ..... 422/49, 72; 210/360.1, 210/781, 782; 74/572, 573 R, 574; 494/16, 17, 19–21, 34, 43, 81, 82, 85

[56] References Cited

U.S. PATENT DOCUMENTS

| | | | |
|---|---|---|---|
| 1,730,776 | 10/1929 | Lundgren | 494/16 |
| 2,447,330 | 8/1948 | Grebmeier | 494/16 |
| 2,878,992 | 3/1959 | Pickels et al. | 494/16 X |
| 3,720,368 | 3/1973 | Allen | 494/16 |
| 3,825,178 | 7/1974 | Burg | 494/16 |
| 3,970,245 | 7/1976 | Aeschlimann | 494/16 X |
| 4,412,830 | 11/1983 | Strain et al. | 494/16 X |
| 4,449,965 | 5/1984 | Strain | 494/16 |
| 4,484,906 | 11/1984 | Strain | 494/16 |
| 4,509,940 | 4/1985 | Romanauskas | 494/37 X |
| 4,553,955 | 11/1985 | Lam et al. | 494/16 |
| 4,801,290 | 1/1989 | Gunter | 494/16 |
| 4,820,257 | 4/1989 | Ishimaru | 494/16 |
| 4,824,429 | 4/1989 | Keunen et al. | 494/81 X |
| 4,832,679 | 5/1989 | Bader | 494/16 |

FOREIGN PATENT DOCUMENTS

| | | | |
|---|---|---|---|
| 3724091 | 6/1988 | Fed. Rep. of Germany | 494/16 |
| 606945 | 4/1920 | France | 494/16 |

*Primary Examiner*—Harvey C. Hornsby
*Assistant Examiner*—Charles Cooley

[57] ABSTRACT

An angular head for centrifuges serves to receive a plurality of beakers which are arranged inclined at a fixed angle to the vertical in recesses in the angular head. The angular head is developed in at least two parts and consists of a mechanically loadable outer part and a less loadable inner part, the inner part being connected to the outer part at least in the region of the rotor hub, and the outer part having on its outer circumference in the vicinity of the bottom of the beakers an annular bottom part which is bent at an angle radially inward and the inner part having an outwardly bent part adjacent the annular bottom part. The outwardly bent part and annular bottom part define a joint therebetween for preventing transmission of a load between the outwardly bent part and annular bottom part.

14 Claims, 1 Drawing Sheet

ANGULAR HEAD FOR CENTRIFUGES

SUMMARY OF THE INVENTION

The object of the present invention is an angular head for centrifuges in accordance with the preamble to claim 1. Such an angular head having stationary non-swinging beakers is, as a rule, produced at a high cost of manufacture. As a rule, such an angular head is milled from a solid material, the receiving holes for the reception of the beakers being produced also by a large number of successive drilling and milling processes.

The object of the present invention, is therefore, so to develop an angular head for centrifuges of the aforementioned type that, while having traditional load-receiving capacities comparable to angular heads of the prior art, it can be produced at substantially less expense and more easily.

In order to achieve the object, the invention is characterized by the fact that the outer part is provided on its outer periphery, in the vicinity of the bottom of the beakers, with a radial bottom part which is bent inwards at an angle and extends over the center of the bottom of the beaker, and by the fact that the radially inwardly lying supporting surface for the beakers is formed by the inner part.

The two parts are preferably connected to each other in the region of the horizontal cover flange of the angular head, because favorable attachment surfaces are present here since the two parts preferably overlap in this region, thus creating a larger region of attachment.

As a material for making the outer part, which is subjected to relatively high load, it is preferable to use a sheet-metal material which is drawn inward at its outer edge and thus forms a stable support for the bottom region of the beakers inserted into the receiving openings of the angular head. Glass tubes containing the material to be examined are inserted into the beakers which, as a rule, are formed as plastic sleeves.

The inwardly drawn collar on the outer edge of the outer part can be formed at a right angle or in rounded shape and extends over the center of the bottom of the tube in order, in this way, to assure a supporting surface for the bottom of the tube during the centrifuging as well as when standing.

In this way, it is possible to produce the outer part (from sheet-metal) by pressing or drawing, which results in considerable advantages in manufacture.

On the other hand, the inner part can be formed by injection molding or casting from an inexpensive plastic material, and the inner part serves essentially only as radially inwardly directed supporting surface for the beakers which are inserted into the receiving holes and therefore does not have to transmit any centrifugal forces.

The joint between the inner part and the outer part is preferably arranged in the region of the bottom of the beaker in order, in this way, to assure a substantially closed angular head, which is thus developed in a manner which is particularly favorable from a standpoint of flow. The inner part thus serves substantially as wind protection within the region of the beaker.

It is important in this connection that the inner part also forms the rotor hub and thus transmits the rotary drive forces acting on the angular head via the attachment arranged in the surrounding region of the rotor hub between the inner part and the outer part to the outer part.

As already mentioned above, the inner part and the outer part overlap in this region and thus large load-transmitting surfaces can be created between the two parts, via which it is possible in simple manner, on the one hand, to transmit the centrifugal forces of the outer part to the inner part and, on the other hand, to transmit the moment-of-rotation loads from the inner part to the outer part.

The recesses on the top of the outer part for the reception of the corresponding beakers are of elliptical shape. The plastic part is developed cylindrically over a distance in each case in the upper and lower regions and therefore developed vertically in order to be able to fasten favorable balancing weights there. In other words, annular spaces are formed on the inner circumference on the inner part, which spaces are not filled by the inserted beakers, so that corresponding balancing weights can be introduced into these annular spaces.

The object of the present invention can be noted not only from the individual claims but also from a combination of the individual claims with each other.

All indications and features disclosed in the papers—including the abstract—and particularly the three-dimensional development shown in the drawings are claimed as essential to the invention, insofar as, individually or in combination, they are novel as compared with the prior art.

The invention will be further explained below on basis of drawings which show merely one embodiment. In this connection, further essential features and advantages of the invention will be evident from the drawings and the description of them.

DESCRIPTION OF THE PREFERRED EMBODIMENT

Figure 1:
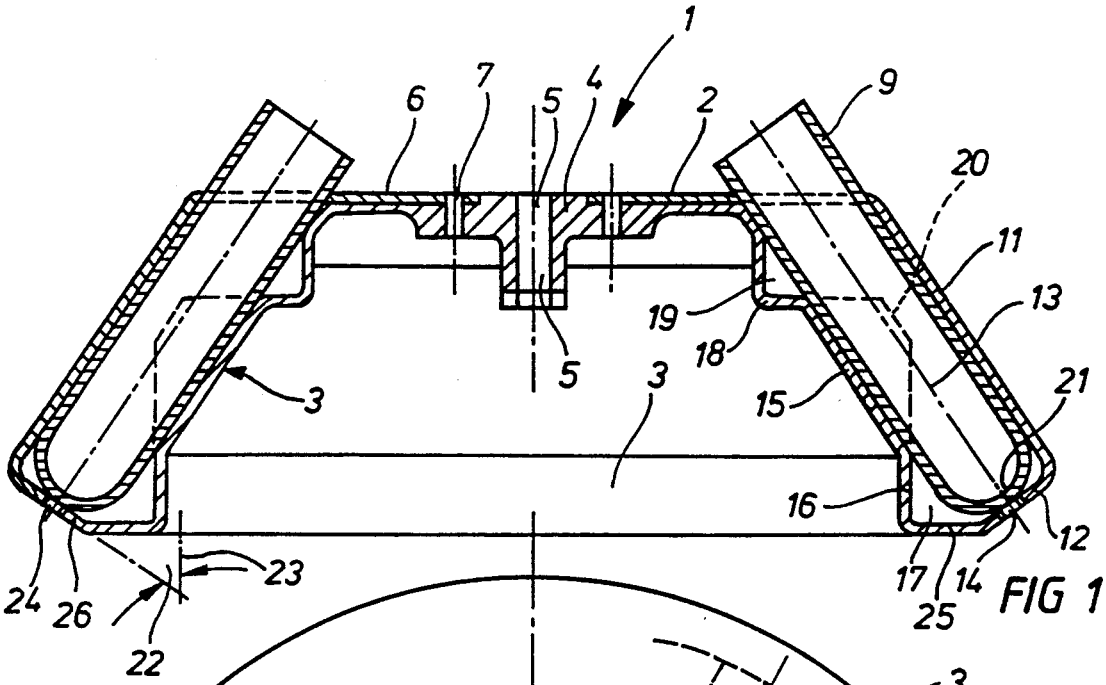
FIG. 1 is a section through an angular head according to the invention.

The angular head 1 consists essentially of a pot-shaped outer part 2 preferably made of sheet metal, it having, first of all, an upper, horizontally extending cover ring 6.

In the region of the cover ring 6, there are developed elliptical recesses 10 into which beakers 9 are inserted. Glass tubes (not shown in detail) which contain the liquid to be examined are, in their turn, adapted to be inserted into the beakers.

From the outer periphery of the upper horizontal cover ring 6 there extends the pot-shaped outer part 2 which is directed obliquely radially outward and forms there a side ring 11 which, in the vicinity of the bottom of the beaker, passes into an inwardly directed bent annular bottom part 12.

It is important that the length of the bottom part 12 be such that the bottom part 12 extends beyond the longitudinal center axis 13 of the beakers 9 so that the beakers 9 are seated on the bottom part 12 in all functional positions. The bottom part 12 therefore transmits the centrifugal load of the beaker 9 onto the side ring 11 and the side ring 11 transmits the centrifugal load to the horizontal cover ring 6 of the outer part 2.

The inner wall of the angular head 1 is formed by an inner part 3, also of a pot shape, which is preferably formed of a plastic part. The inner part 3 has the receiving bore 5 for the rotor hub 4 and also forms a horizontal disk-shaped region on which the cover ring 6 of the outer part 2 is arranged in an overlapping manner. The cover ring 2 is connected to the inner part 3 within the region of the rotor hub 4 via screws 7 which are distributed on the circumference.

Extending from the horizontal surface of the rotor hub 4, the latter passes into a radially outwardly inclined inner disk 15, bends 16, 18 being arranged in the region of the inner disk 15 and forming in each case an annular space 17, 19 into which balancing weights can be introduced.

In the region of the bottom, the inner part 3 forms a horizontally directed part 25 which, in its turn, passes at its radially outer end into an obliquely outwardly bent part 26. The part 26 forms a joint 24, over which no load is transmitted, with the bottom region 12.

Corresponding to the angular position of the lengthwise center line 13 of the beaker 9, the bottom part 12 is thus perpendicular to the longitudinal center line of the beaker 9 and, in position 14, takes up the centrifugal force which is exerted by the beaker bottom 21 on the bottom part 12 at position 14.

Figure 2:
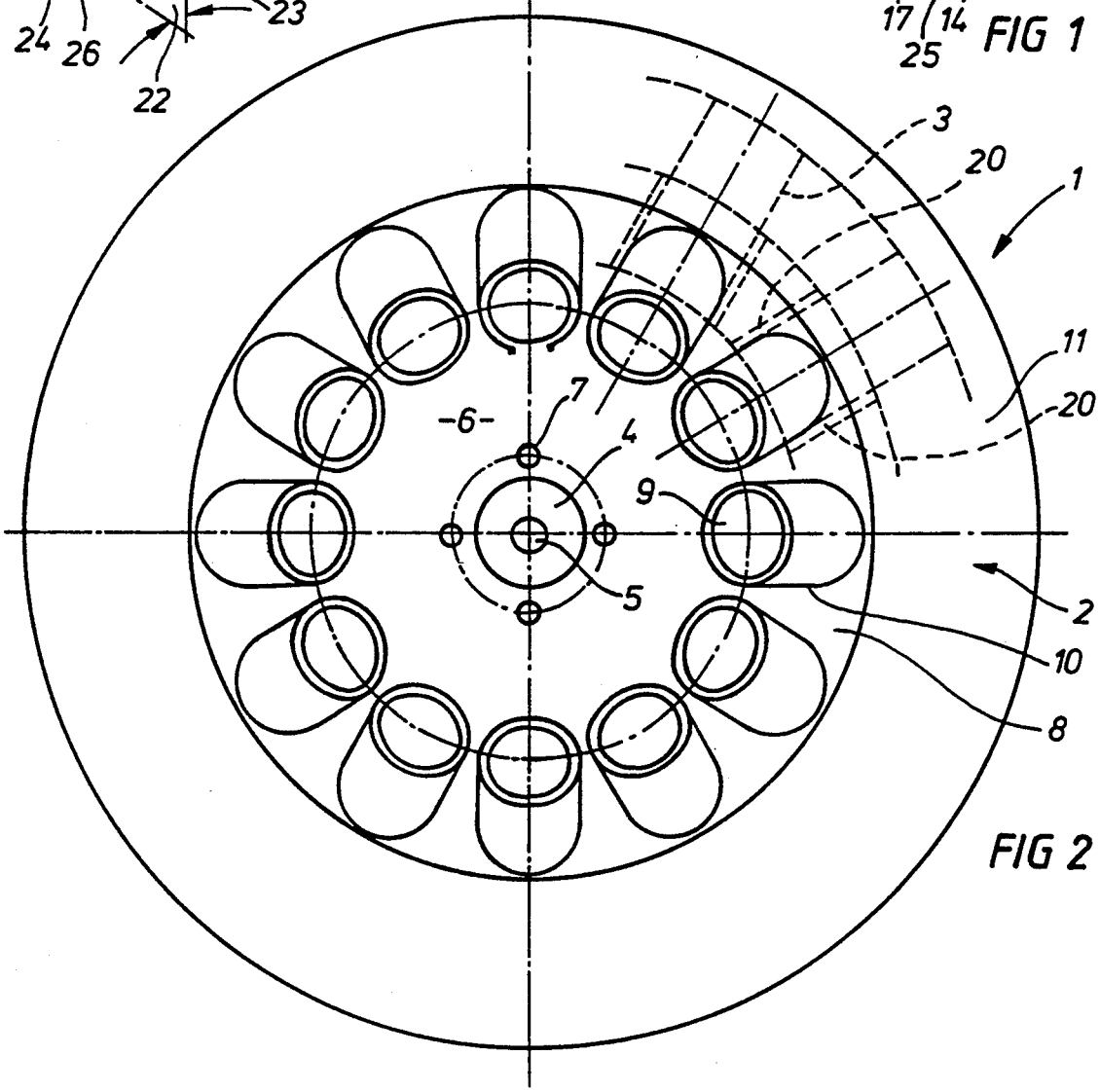
FIG. 2 is a top view of the angular head of FIG. 1.

In order to secure the beakers 9 inserted into the elliptical recesses 10 against shifting, webs 20, arranged in each case in pairs parallel to each other, are formed on the inner part 3 on the outer circumference of the inner part 3, as shown in FIG. 2, said webs forming the lateral displacement limitation for the beakers 9 inserted into the receiving bores 10.

In this connection, the webs 20 lie at about the mid-height of the length of the beakers below the circular-ring region 8 of the elliptical recesses 10.

I claim:

1. An angular head for a centrifuge having a vertical axis of rotation for receiving a plurality of beakers having open tops and closed bottoms which are arranged inclined at a fixed angle to the vertical axis in recesses in the angular head, the angular head comprising at least two parts symmetrically arranged relative to the vertical axis, the angular head including a mechanically loadable outer part and an inner part subjectable to loads less than the loads applied to said outer part, said inner part forming a rotor hub coaxial with the vertical axis, said inner and outer parts being connected to each other to share common rotations about the vertical axis, said outer part having a side ring member and an adjacent annular bottom part which is bent radially inwardly at an angle from said side ring member, said inner part having an inner disk and an outwardly bent part which together with said side ring member and said adjacent annular bottom part together form the recesses for receiving and supporting the beakers at the fixed angles to the vertical axis, said recesses defining supporting surfaces for directly supporting the plurality of beakers, supporting surfaces formed by said outwardly bent part and said annular bottom part, at least one of which supports a bottom portion of the beakers, defining a joint means therebetween for preventing transmission of a load between said outwardly bent part and said annular bottom part.

2. An angular head according to claim 1, characterized in that said outer part is completely made from sheet-metal.

3. An angular head according to claim 2, characterized in that said inner part is made of plastic.

4. An angular head according to claim 3, characterized in that said inner part which forms said rotor hub is provided with a drive shaft bore.

5. An angular head according to claim 4, characterized in that said outer part has a horizontal cover ring which is attached to said inner part in a region surrounding the rotor hub.

6. An angular head according to claim 5, characterized in that said inner part is provided with at least one annular space on an inner circumference of said inner part.

7. An angular head according to claim 6, characterized in that a second annular space for positioning balancing weights is formed in said inner part, and wherein one of said annular spaces is provided adjacent to said outwardly bent part.

8. An angular head according to claim 6, characterized in that each said recess in the angular head is provided with a pair of lateral webs spaced apart from each other on said inner part, wherein said webs secure the beakers against shifting in a circumferential direction in said recesses.

9. An angular head according to claim 8, characterized in that said lateral webs are disposed within a mid-height range with respect to the length of said beakers in said recesses.

10. An angular head according to claim 8, characterized in that said recesses are elliptical in shape.

11. An angular head according to claim 10, characterized in that said webs form a lateral displacement limitation for said beakers.

12. An angular head according to claim 1, characterized in that said outwardly bent and annular bottom parts are arranged in a plane which forms an angle with the vertical axis.

13. An angular head according to claim 12, characterized in that said angle formed with the vertical axis is an acute angle.

14. An angular head according to claim 12, wherein said plane is arranged normal to the inclined fixed angle orientation at each beaker position.

* * * * *